US012264856B2

(12) United States Patent
Bouquet

(10) Patent No.: US 12,264,856 B2
(45) Date of Patent: Apr. 1, 2025

(54) CONDENSER SUBASSEMBLY WITH INTEGRATED FLASH TANK

(71) Applicant: Carrier Corporation, Palm Beach Gardens, FL (US)

(72) Inventor: Xavier-Pierre Nicolas Bouquet, Montluel (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 56 days.

(21) Appl. No.: 17/133,866

(22) Filed: Dec. 24, 2020

(65) Prior Publication Data

US 2021/0348809 A1 Nov. 11, 2021

(30) Foreign Application Priority Data

May 6, 2020 (EP) ..... 20173152

(51) Int. Cl.
*F25B 39/04* (2006.01)
*F25B 13/00* (2006.01)

(52) U.S. Cl.
CPC ..... *F25B 39/04* (2013.01); *F25B 13/00* (2013.01); *F25B 2400/13* (2013.01)

(58) Field of Classification Search
CPC ..... F25B 39/04; F25B 39/00; F25B 2400/13; F25B 41/00; F25B 2500/09; F25B 2500/05
See application file for complete search history.

(56) References Cited

U.S. PATENT DOCUMENTS 2,277,647 A * 3/1942 Jones ..... F25B 1/053 62/197
2,888,809 A 6/1959 Rachfal
4,332,642 A * 6/1982 Cane ..... C02F 1/06 202/180
4,437,322 A * 3/1984 Ertinger ..... F28F 9/026 62/504
2018/0209709 A1* 7/2018 Matsukura ..... F25B 49/022

FOREIGN PATENT DOCUMENTS

CN 203964469 U 11/2014
JP S504344 U 1/1975
JP S53157462 U 12/1978
WO WO-2006083329 A2 * 8/2006 ..... F25B 1/10

OTHER PUBLICATIONS

European Search Report for application EP 20173152.8, dated Oct. 12, 2020, 7 pages.
European Search Report for Application No. 20173152.8; Issued Feb. 24, 2023; 4 Pages.

* cited by examiner

*Primary Examiner* — Jerry-Daryl Fletcher
*Assistant Examiner* — Keith Stanley Myers
(74) *Attorney, Agent, or Firm* — CANTOR COLBURN LLP

(57) ABSTRACT

A condenser subassembly for providing an economizer function in a refrigeration circuit, the condenser subassembly including: a condenser chamber 113; a flash tank chamber 114; an expansion device 117; and a housing, the housing defines a vessel 112*a*, the vessel comprising the condenser chamber 113 and the flash tank chamber 114, the condenser chamber 113 and the flash tank chamber 114 are separated from one another by a partition 115*a* in the vessel 112*a* and the expansion device 117 is arranged to pass condensed refrigerant from the condenser chamber 113 to the flash tank chamber 114.

14 Claims, 3 Drawing Sheets

CONDENSER SUBASSEMBLY WITH INTEGRATED FLASH TANK

FOREIGN PRIORITY

Figure 1A:
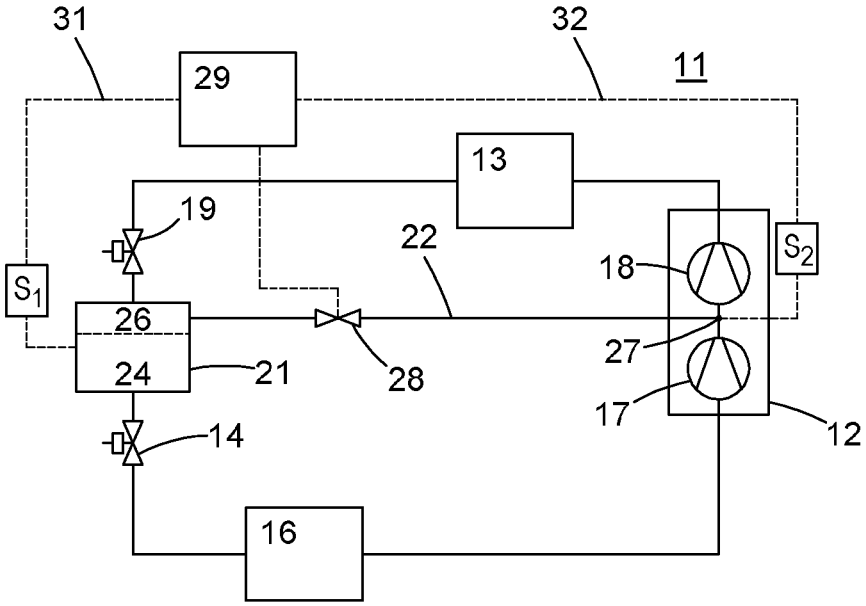

This application claims priority to European Patent Application No. 20173152.8, filed May 6, 2020, and all the benefits accruing therefrom under 35 U.S.C. § 119, the contents of which in its entirety are herein incorporated by reference.

TECHNICAL FIELD

The present invention relates to a condenser subassembly for providing an economizer function in a refrigeration circuit, a refrigeration circuit comprising such a condenser assembly and a method of manufacturing such a condenser subassembly.

BACKGROUND

Refrigeration circuits comprise a compressor, a condenser (i.e. a heat rejecting heat exchanger), an expansion device, and an evaporator (i.e. a heat absorbing heat exchanger) and are used to refrigerate or heat an environment or substance. Economizer cycles are sometimes employed to increase the efficiency and capacity of the system.

One form of an economizer cycle utilises a flash tank and operates by expanding refrigerant leaving the condenser to an intermediate pressure in the flash tank (a lower pressure than that of the refrigerant in the condenser but a higher pressure than that in the evaporator) and separating the expanded refrigerant flow.

The vapour refrigerant is directed to the economizer port of a compressor and the liquid refrigerant is directed to the evaporator via a second, main expansion valve. The main benefit of this separation of vapour and liquid refrigerant is that it lowers the enthalpy of the liquid refrigerant remaining in the flash tank, which is subsequently expanded and enters the evaporator, thus increasing the heat transferred by the evaporator and therefore increasing the overall capacity and efficiency of the circuit. This effect of an economizer cycle is well understood in the art of refrigeration circuits.

Alternatively, an economizer cycle may utilise an economizer heat exchanger (rather than the flash tank method described above) and operate by splitting the flow of refrigerant from the condenser into a main flow and an economizer flow, before any expansion occurs. The economizer flow can then be expanded and used to sub-cool the main flow by means of a heat exchanger before the main flow itself is expanded and enters the evaporator.

SUMMARY

In a first aspect, the present invention provides a condenser subassembly for providing an economizer function in a refrigeration circuit, the condenser subassembly comprising: a condenser chamber; a flash tank chamber; an expansion device; and a housing, wherein the housing defines a vessel, the vessel comprising the condenser chamber and the flash tank chamber, wherein the condenser chamber and the flash tank chamber are separated from one another by a partition in the vessel and wherein the expansion device is arranged to pass condensed refrigerant from the condenser chamber to the flash tank chamber.

Typical prior art systems such as those described above that have a dedicated flash tank assembly use a lot of space through piping, supporting brackets and the like, and can be relatively costly to implement. By having a single housing and vessel incorporating both a condenser chamber and a flash tank chamber, as proposed in the first aspect, a single subassembly can perform both the condenser and economizer functions. The condenser chamber and flash tank chamber may therefore be referred to as integrated chambers. In this way, the amount of piping required can be reduced, space can be preserved and overall installation and manufacturing costs reduced.

It will be appreciated that the term refrigeration circuit should be taken to include the circuit when used in a refrigerator (e.g. a liquid chiller) or a heat pump, as the cycle is the same in both instances, it is only the use of the system that is different.

The expansion device may be an internal expansion device positioned inside of the vessel and housing. By utilising an internal expansion device, the condenser subassembly conserves additional space as no associated external piping is required. Furthermore, such an internal expansion device may be more robust as it is shielded from an outside environment.

Alternatively, the expansion device may be an external expansion device, positioned outside of the housing. Such an external expansion device is easier to access for maintenance or for replacement.

The expansion device may comprise a float valve, or other suitable valve type, coupled with a liquid duct from the condenser chamber to the flash tank chamber. The liquid duct may be inside or outside of the vessel and housing.

The expansion device may be an electronic expansion valve or an orifice device, such as a capillary tube or a float valve. Any of the expansion devices described herein may operate to expand liquid refrigerant flowing through the expansion device into a mixture of liquid and vapour and pass this mixture into the flash tank chamber. In the case of an electronic expansion valve, the expansion valve may be coupled to a level sensor to measure the level of liquid in the flash tank chamber and adjust the opening of the electronic expansion valve accordingly.

The vessel (and housing) may be substantially cylindrical. However, the skilled person will appreciate that the vessel can take any shape as long as it may be divided by the partition into the condenser chamber and flash tank chamber and the expansion device can pass liquid between these two chambers. For example, the vessel and/or housing may have a shape known for pressure vessels, such as tubular or prismatic shapes, including cylinders and including forms with or without rounded ends.

The partition may divide the vessel into two pressure envelopes, with one pressure envelope inside of a pressure envelope of the vessel. For example, the vessel may be an outer vessel and the partition may comprise an inner vessel within the outer vessel. This inner vessel may contain the flash tank chamber or the condenser chamber. The inner vessel may be substantially cylindrical.

Alternatively, the inner vessel may have a substantially semi-circular cross-section. The inner vessel may have a cross-section that is a partial circle, and this cross-section may resemble a circle that has a circular segment removed along a chord length.

It will be appreciated that the vessel size and shape can be optimised for a particular set of operating conditions of the condenser subassembly.

A portion of the outer surface of the inner vessel may be curved. Part of the outer surface of the inner vessel may have a contour that matches an inner contour of the outer vessel.

The partition may divide the vessel at a chord length in its cross-section. The partition may extend fully or partially along the length of the vessel.

By utilising a vessel and partition of the above arrangements, a pre-existing pressure vessel from a condenser subassembly can be repurposed for use in the subassembly of the first aspect. Such vessels, which may typically be cylindrical, are of course already suited to the pressure envelope of the condenser chamber and can have pre-existing regulatory/design approvals. This provides an easier way to add the economiser capability to an existing system rather than needing an additional fully-self-contained pressure vessel as well as potentially streamlining the design/approval process by avoiding new forms of pressure vessel. For example, by adding an inner vessel for the flash tank chamber inside of an existing vessel having pre-existing regulatory/design approvals for a condenser assembly. Such configurations also allow the relevant volumes of the vessel and respective chambers to be calculated easily.

The partition may be reinforced or strengthened in order to withstand the pressure envelopes of the flash tank chamber and the condenser chamber. In particular, the partition may be reinforced or strengthened in order to withstand the pressure difference between the two chambers.

The housing and/or condenser chamber may comprise an inlet that is arranged to be fluidly connected to the pressure port of a compressor and this may be via other system components such as an oil separator and/or sound muffler.

The condenser chamber may comprise a heat exchanger arranged to cool the refrigerant in the chamber in order to condense it. The heat exchanger may comprise a plurality of heat exchanger tubes. The plurality of heat exchanger tubes may extend along the length of the condenser chamber. The plurality of heat exchanger tubes and condenser chamber may form a tube-in-shell heat exchanger arrangement. The plurality of heat exchanger tubes may be arranged to be surrounded by refrigerant that is to be condensed. However, the skilled person will appreciate that any suitable heat exchanger can be employed in order to cool and condense the refrigerant in the condenser chamber.

The heat exchanger tubes may be arranged to receive water and/or any other suitable coolant fluid (e.g. water mixed with glycol for the prevention of freezing) in order to cool the refrigerant in the condenser chamber. The water or other suitable coolant fluid may be received from a separate refrigeration circuit.

The expansion device may be fluidly connected to a point near the bottom of the condenser chamber, where, during use, condensed refrigerant will collect under the action of gravity. This may be the lowest point of the condenser chambers such that any condensed refrigerant can be passed to the flash tank chamber.

The condenser chamber may extend along the full length of the vessel. The flash tank may extend along the full length of the vessel. This maximises the space utilised and thus the possible effectiveness of these components.

Alternatively, the condenser chamber and/or flash tank chamber may extend along part of the length of the vessel. This allows the remaining space in the vessel to be reserved or other components.

For example, an oil separator may be incorporated inside of the vessel. Thus, the vessel may comprise a condenser chamber, flash tank chamber and an oil separator. The oil separator may be in an oil separator chamber of the vessel. The oil separator may remove oil from a refrigerant flow before it enters the condenser chamber.

Additionally, or alternatively, a sound muffler may be incorporated inside of the vessel. Thus, the vessel may comprise a condenser chamber, flash tank chamber, an oil separator and a sound muffler. The sound muffler may be in a sound muffler chamber of the vessel.

In the case of a system employing these optional features, refrigerant flowing through the circuit from the discharge port of a compressor may pass through the sound muffler, followed by the oil separator, condenser chamber and then the flash tank chamber.

The flash tank chamber may comprise a vapour outlet and a liquid outlet. The liquid outlet may be arranged to be fluidly connected to an evaporator via a further expansion device. The vapour outlet may be arranged to be connected to an economizer line and/or an economizer port of a compressor.

The flash tank chamber may comprise an inlet for fluid from the condenser, which may be provided by the liquid duct mentioned above.

The condenser subassembly may comprise a screen inside of the vessel. The screen may be positioned within the flash tank chamber. The screen may be arranged to disrupt, slow and/or steady the flow path of refrigerant to the vapour outlet and/or liquid outlet. The screen may be arranged to prevent refrigerant liquid spray from reaching the vapour outlet. This is undesirable as only vapour should exit via the vapour outlet. In some examples the screen blocks a line of sight between the vapour outlet and the inlet for fluid from the condenser.

In a second aspect, the present invention provides a refrigeration circuit comprising: a condenser subassembly as claimed in any previous claim; a compressor; and an evaporator; wherein the condenser subassembly has a vapour outlet which is fluidly connected to an economizer port of the compressor and a liquid outlet which is fluidly connected to the evaporator via an expansion device, and wherein a discharge (i.e. pressure or exhaust) port of the compressor is fluidly connected to the condenser chamber, optionally via any of the additional intermediate components described herein.

The condenser subassembly may be attached/fixed to the compressor, thus conserving even more space by minimising piping and supports between the two.

The compressor may be a multi-stage compressor. The compressor may have a lower compression stage and higher compression stage and the economizer port may be positioned at an intermediate stage between the two. The economizer port of the compressor may be arranged between stages of the compressor such that it receives the vapour refrigerant from the flash tank. As a result of the separation of vapour and liquid refrigerant in the flash tank, the remaining liquid refrigerant in the flash tank (which is subsequently expanded and passed to the evaporator) has a lower enthalpy, therefore increasing the capacity and efficiency of the system as described previously.

The vapour outlet may be fluidly connected to the economizer port of the compressor via an economizer vapour line. The economizer vapour line may comprise a flow regulating valve that is arranged to control the rate of flow of refrigerant in the economizer line.

The flow regulating valve may be controlled by a controller. The controller may be connected to a sensor in the flash tank and/or a sensor in the compressor in order to measure conditions of the refrigerant at the flash tank and/or compressor. A sensor at the compressor may measure conditions at a mid-stage point of the compressor. The conditions may comprise temperature, pressure and/or rate of flow. The flow regulating valve may be controlled based on any of these sensed conditions.

The evaporator may be configured to cool a gas or liquid passing over it as the refrigerant therein is heated and evaporated. The evaporator may cool a refrigerated area such as a refrigerated compartment via coolant fluid for example.

The condenser chamber may receive refrigerant from the discharge port of the compressor (optionally via any of the additional, intermediate components described herein) and function to cool the refrigerant therein so that it condenses to a liquid.

The refrigeration circuit may comprise an oil separator arranged to remove oil from a refrigerant flow. The oil separator may be positioned in the refrigerant circuit between the compressor discharge port and the condenser chamber to remove oil from a refrigerant flow before it enters the condenser chamber. The oil separator may be integrated into the condenser subassembly. The oil separator may be positioned within the vessel and/or housing. Oil is typically introduced into the refrigerant in the compressor but should be removed before the refrigerant is condensed to improve efficiency and avoid oil traps in the refrigeration circuit. Oil that is removed from the refrigerant by the oil separator may be returned to the compressor to be re-used. The oil may be returned to the compressor directly or via an intermediate oil tank.

In a third aspect, the present invention provides a method of manufacturing a condenser subassembly for providing an economizer function in a refrigeration circuit, the method comprising: providing a housing, wherein the housing defines a vessel; providing a partition in the vessel; providing a condenser chamber and a flash tank chamber in the vessel, wherein the condenser chamber and the flash tank chamber are separated from one another by the partition in the vessel; and providing an expansion device, wherein the expansion device is arranged to pass condensed refrigerant from the condenser chamber to the flash tank chamber.

The method of manufacturing a condenser subassembly may form the condenser subassembly for providing an economizer function in a refrigeration circuit according to the first aspect, including providing any of the optional features described herein.

The vessel (or housing) may be a pre-existing pressure vessel. The pre-existing pressure vessel may be part of an existing condenser subassembly. The method may comprise retrofitting the partition to the pre-existing pressure vessel in order to form the condenser chamber and flash tank chamber. In this way, a pre-existing pressure vessel that has already been approved for meeting industry standards may be used. The vessel may be pre-approved for use with the pressure envelopes of the condenser chamber and optionally the flash tank chamber.

The method may comprise determining a volume of the vessel that is required in order to provide a certain economizer function in a refrigeration circuit.

The method may comprise determining a volume of the condenser chamber and/or a volume of the flash tank chamber that is required in order to provide a certain economizer function in a refrigeration circuit.

The method may comprise designing a flash tank chamber and/or a condenser chamber to fit in an available volume. This may maximise the use of available space.

The method may comprise determining a position and/or a required strength of the partition in the vessel in order for the partition to withstand a pressure difference between the condenser chamber and flash tank chamber when the condenser subassembly provides a certain economizer function.

DRAWING DESCRIPTION

Figure 1B:
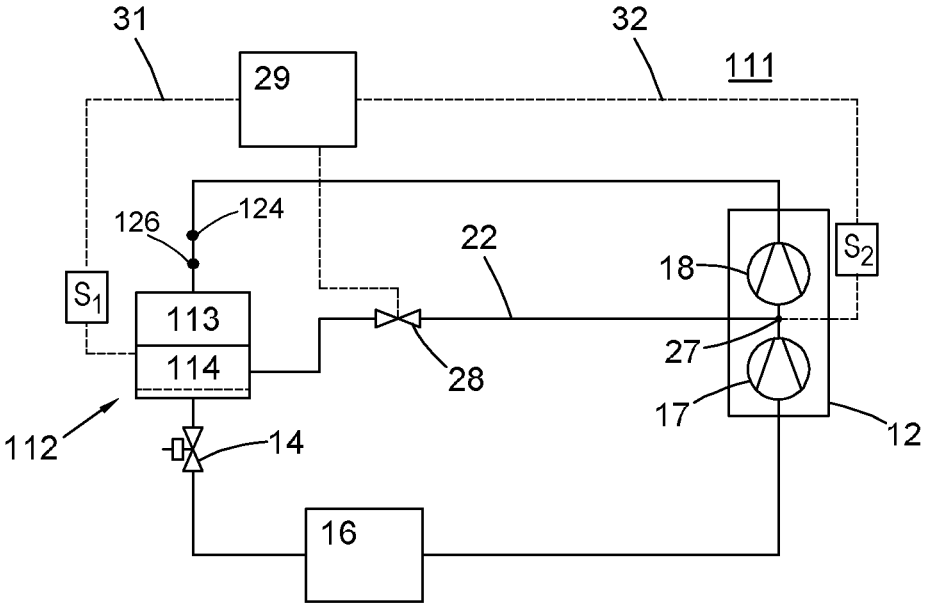
Figure 2:
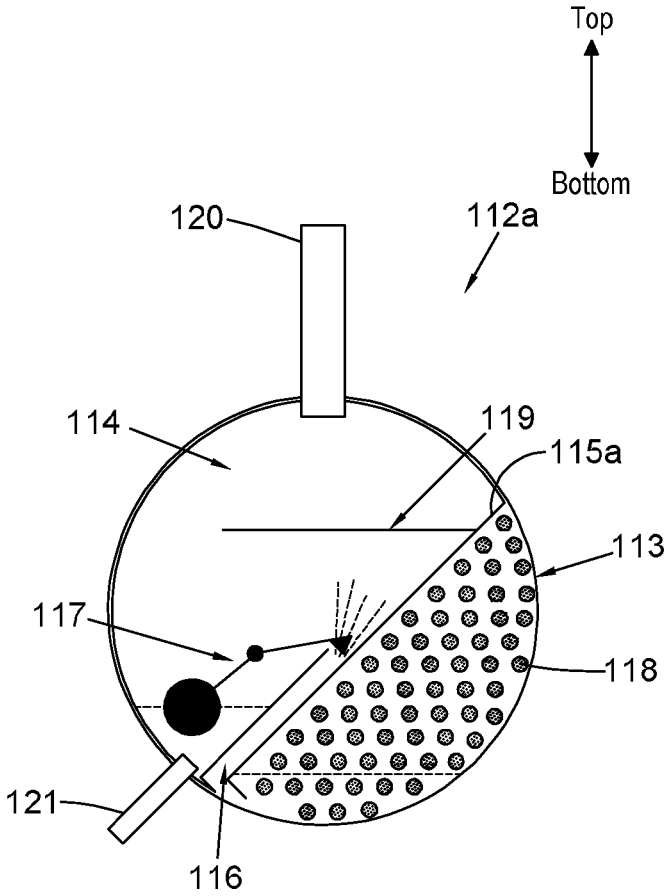
Figure 3:
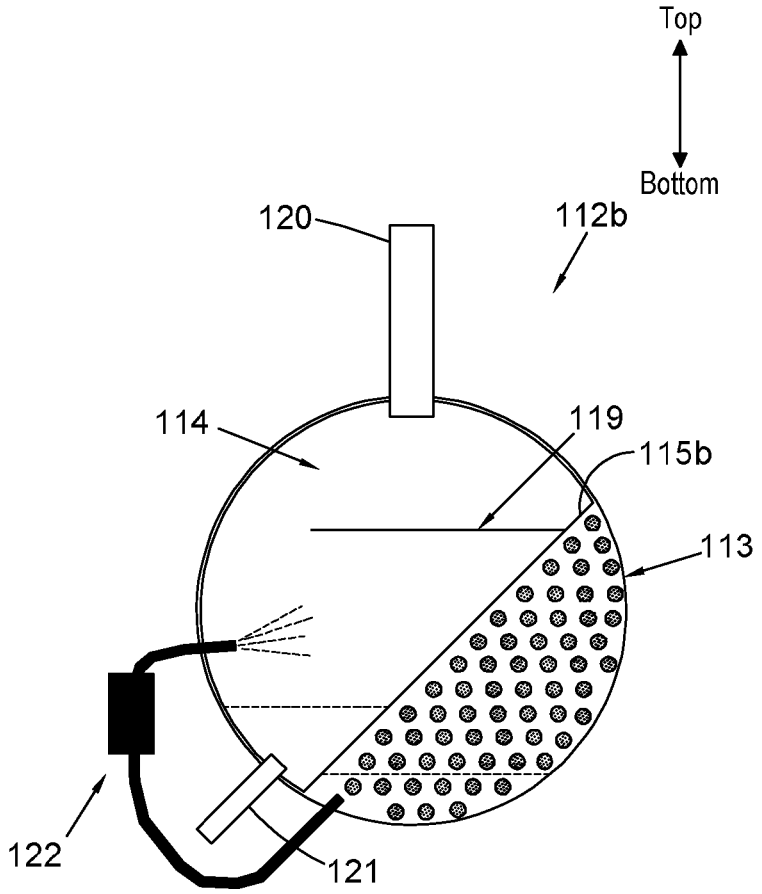

Certain example embodiments will now be described by way of example only and with reference to the accompanying drawings, in which:

FIG. 1*a* shows a schematic view of a known refrigeration circuit comprising a flash tank economizer;

FIG. 1*b* shows a schematic view of a refrigeration circuit comprising a condenser subassembly for providing an economizer function with an integrated flash tank chamber;

FIG. 2 shows a cross-sectional view of a condenser subassembly comprising an integrated flash tank chamber and an internal expansion device; and FIG. 3 shows a cross-sectional view of another condenser subassembly comprising an integrated flash tank chamber and an external expansion device.

DETAILED DESCRIPTION

With reference to FIG. 1*a*, there is shown a conventional refrigeration circuit 11 that includes, in serial flow relationship, a compressor 12, a condenser 13, a flow control device 19, a flash tank 21, an expansion device 14, and an evaporator 16.

The compressor 12, which functions to compress and circulate refrigerant through the refrigeration circuit, comprises a single, multi-stage compressor having a lower compression stage 17 and higher compression stage 18.

The condenser 13 receives refrigerant from the discharge port of the compressor 12 and functions to cool the refrigerant therein so that it condenses to a liquid.

The evaporator 16 functions to cool a gas or liquid passing over it as the refrigerant therein is heated and evaporated. The heated vapour then passes to an inlet of the compressor 12.

Disposed between the condenser 13 and the expansion device 14 is the flow control device 19 and the flash tank 21. The flash tank 21, together with an economizer vapour line 22 fluidly interconnecting the flash tank 21 to an economizer port of the compressor 12, forms part of an economizer circuit.

In operation, the refrigerant exiting the condenser 13 passes through the flow control device 19 where it is expanded to reduce its pressure. The resulting mixture of liquid and vapour then enters the flash tank 21, with the liquid 24 settling to the bottom portion of the flash tank 21 and the vapour 26 residing in the top portion of the flash tank 21. The liquid refrigerant 24 passes to the expansion device 14 where it is expanded and subsequently enters the evaporator 16.

In a process known as economized operation, the vapour 26 passes along the economizer vapour line 22 to an economizer port of the compressor 12. As discussed above, a result of the separation of vapour and liquid refrigerant in the flash tank 21 is that the remaining liquid refrigerant in the flash tank 21 (which is subsequently expanded and passed to the evaporator 16) has a lower enthalpy, therefore increasing the capacity and efficiency of the system.

The flow control device 28, which is an electronically controlled flow control device such as a solenoid valve, is controlled by a controller 29 in response to sensed conditions at the flash tank 21 and at the compressor 12. For example, a sensor S1 senses an operational condition at the flash tank 21, and a sensor S2 senses an operational condition at a mid-stage point 27 of the compressor 12. The sensed conditions then cause the controller 29 to either open the flow control device 28 to permit economized operation or to close the flow control device 28 to thereby turn off the economizer.

Now with reference to FIG. 1*b*, there is shown a refrigeration circuit 111 that includes a vessel 112 comprising an integrated condenser chamber 113 and an integrated flash tank chamber 114. The structure of the vessel will be described in more detail below with reference to FIGS. 2 and 3.

The reference numerals in FIG. 1*b* represent similar components as those described above in relation to the same reference numbers of FIG. 1*a*.

Similar to the system shown in FIG. 1*a*, the compressor 12 of the refrigeration circuit 111 functions to compress and circulate refrigerant through the refrigeration circuit, and comprises a single, multi-stage compressor having a lower compression stage 17 and higher compression stage 18.

The vessel 112 receives refrigerant from the discharge port of the compressor 12 and this refrigerant enters the condenser chamber 113 of the vessel first, which functions to cool the refrigerant therein so that it condenses to a liquid. Refrigerant flowing through the circuit from the discharge port of the compressor 12 may pass through a sound muffler 124, followed by an oil separator 126 before reaching the condenser chamber 113.

An expansion device (not shown) inside of the vessel is arranged to pass condensed refrigerant from the condenser chamber 113 to the flash tank chamber 114.

The expansion device and flash tank chamber 114, together with an economizer vapour line 22 fluidly interconnecting a vapour outlet of the flash tank chamber 114 to an economizer port of the compressor 12, form part of an economizer circuit.

In operation, the refrigerant exiting the condenser chamber 113 passes through the expansion device where it is expanded to thereby reduce its pressure. The resulting mixture of liquid and vapour is passed into the flash tank chamber 114, with liquid settling to a bottom portion and the vapour residing in a top portion of the flash tank chamber (the dashed line within the flash tank chamber 114 schematically representing the limit between the liquid and vapour).

The vapour refrigerant passes from a vapour outlet of the flash tank chamber 114 along the economizer vapour line 22 to an economizer port of the compressor 12. As discussed above, a result of the separation of vapour and liquid refrigerant in the flash tank chamber 114 is that the remaining liquid refrigerant in the flash tank chamber 114 (which is subsequently expanded and passed to the evaporator) has a lower enthalpy, therefore increasing the capacity and efficiency of the system.

The liquid refrigerant passes from a liquid outlet of the flash tank chamber 114 to an expansion device 14 where it is expanded and subsequently enters an evaporator 16. Again, the evaporator 16 functions to cool a gas or liquid passing over it as the refrigerant therein is heated and evaporated. The heated vapour then passes to an inlet (suction port) of the compressor 12.

Similar to the previously described system, a flow control device 28, which is an electronically controlled flow control device such as a solenoid valve, is controlled by a controller 29 in response to sensed conditions at the flash tank chamber 114 and at the compressor 12. For example, a sensor S1 senses an operational condition at the flash tank chamber 114, and a sensor S2 senses an operational condition at a mid-stage point 27 of the compressor 12. The sensed conditions then cause the controller 29 to either open the flow control device 28 to permit economized operation or to close the flow control device 28 to thereby turn off the economizer. The controller can also control the rate of flow of refrigerant through the flow control device 28.

Possible structures structure of the vessel 112 will now be described in more detail with reference to FIGS. 2 and 3.

FIG. 2 shows a cross-sectional view of a vessel 112*a* that acts as a condenser subassembly. The vessel 112*a* is cylindrical and has a partition 115*a* dividing the interior of the vessel 112*a* into a condenser chamber 113 and a flash tank chamber 114. The partition 115*a* extends around the flash tank chamber 114 to form a flash tank pressure envelope that is semi-circular.

There is a liquid duct 116 fluidly connecting the bottom of the condenser chamber 113 to the flash tank chamber 114. This is connected to a point near the bottom of the condenser chamber 113 where liquid refrigerant will collect.

Coupled to the liquid duct 116 is an internal float valve 117 that acts as an expansion device for the liquid from the condenser chamber 116 and controls the rate of flow of refrigerant form the condenser chamber 113 into the flash tank chamber.

Inside of the condenser chamber 113 there is a plurality of heat exchanger tubes 118 that pass axially along the length of the chamber and which, in use, are surrounded by refrigerant, which is to be condensed. The heat exchanger tubes pass through the condenser chamber, the refrigerant enters from the top of the condenser chamber 113 and travels down past the heat exchanger tubes 118 through the action of gravity and under the force of the pressure/flow of refrigerant from the compressor.

In the flash tank chamber there is a screen 119 positioned between the liquid duct 116 and a vapour outlet 120. The vapour outlet is positioned towards the top of the chamber and leads to the economizer vapour line and an economizer port of the compressor as described above in relation to FIG. 1*b*.

The flash tank chamber also has a liquid outlet 121 positioned near its bottom that leads to an expansion device where it is expanded and subsequently enters an evaporator as described above in relation to FIG. 1*b*.

In operation, refrigerant passes from a compressor discharge port into the condenser chamber 113, where it is cooled via heat exchange with the plurality of heat exchanger tubes 118. The heat exchanger tubes can be arranged to carry any suitable coolant fluid, such as water or some other refrigerant received from a separate refrigerant circuit.

The refrigerant in the condenser chamber 113 is cooled and condensed such that it collects towards the bottom of the condenser chamber 113. The float valve 117 remains open as long as the liquid level in the flash tank chamber 114 has not risen high enough to push the float of the float valve upwards. When the float is pushed upwards by a rising liquid level in the flash tank chamber 114, a closing part on the other end of a pivoting arm of the float valve 117 reduces the size of the orifice through which refrigerant can flow from the condenser chamber 113 to the flash tank chamber 114, thus reducing the flow rate. The float valve is arranged to control the flow rate in this way in order to match the flow rate of refrigerant leaving the flash tank chamber 114, thereby maintaining a substantially constant liquid level in the flash tank chamber 114.

The vessel thus comprises two different pressure envelopes, the higher pressure envelope of the condenser chamber 113 and the lower pressure envelope of the flash tank chamber 114.

The screen 119 in the flash tank chamber 114 slows the flow of refrigerant towards the vapour outlet so that it has time to expand properly in the flash tank chamber 114. The screen also prevents liquid refrigerant splash or spray from entering the vapour outlet 120 to ensure that the refrigerant which exits the vapour outlet 120 is only expanded vapour and not liquid, which is undesirable.

The refrigerant in the flash tank chamber 114 then separates into liquid towards the bottom and vapour towards the top portion of the flash tank chamber 114 (the two phases are shown separated by a horizontal dashed line in the flash tank chamber 114 of FIG. 2).

As discussed above in relation to FIG. 1*b*, the vapour refrigerant passes from the vapour outlet 120 of the flash tank chamber 114 along an economizer vapour line to an economizer port of the compressor. The liquid refrigerant passes from the liquid outlet 121 of the flash tank chamber 114 to an expansion valve 14 where it is expanded and subsequently enters an evaporator.

FIG. 3 shows a cross-sectional view of another vessel 112*b* that acts as a condenser subassembly. This vessel 112*b* essentially comprises the same components and operates in a similar manner to the vessel shown in FIG. 2 as described above but in place of the liquid duct 116 and internal float valve 117, this vessel comprises an external expansion device 122. As the liquid duct 116 is no longer required, the partition 115*b* fully divides the interior of the vessel into the condenser chamber 113 and the flash tank chamber 114, thus sealing the two from one another.

The external expansion device 122 is fluidly connected to a point near the bottom of the condenser chamber 113 and draws condensed liquid refrigerant out of the condenser chamber, expands it and passes it into the flash tank chamber 114 where the refrigerant separates into a liquid and vapour as previously described.

The expansion device 122 may be an electronic expansion valve, or a fixed orifice device, such as a capillary tube, all of which operate to expand the liquid refrigerant flowing through the expansion device 122 into a mixture of liquid and vapour that is passed into the flash tank chamber 114.

It is worth noting that in any of the embodiments described above, the vessel 112, 112*a*, 112*b* may be formed from a pre-existing pressure vessel that has already been approved for meeting industry standards for use with the pressure envelopes of the condenser chamber 113 (and the flash tank chamber 114). As such, any of the partition 115*a*, 115*b*, liquid duct 116, screen 119 and float valve 117 or expansion device 122 may be retrofitted to such a pressure vessel.

What is claimed is:

1. A condenser subassembly for providing an economizer function in a refrigeration circuit, the condenser subassembly comprising:

a condenser chamber;

a flash tank chamber;

a housing, wherein the housing defines a vessel, the vessel comprising the condenser chamber and the flash tank chamber, wherein the condenser chamber and the flash tank chamber are separated from one another by a partition in the vessel; and an expansion device positioned inside of the vessel and coupled with a liquid duct from the condenser chamber to the flash tank chamber, wherein the expansion device is arranged to pass condensed refrigerant from the condenser chamber to the flash tank chamber;

wherein the expansion device is an internal float valve comprising:

a float inside the flash tank chamber;

a closing part inside the flash tank chamber defining an orifice through which refrigerant can flow from the condenser chamber to the flash tank chamber; and a pivoting arm connected to the float on one end and to the closing part on another end; and wherein the float, the pivoting arm and the closing part are configured to close the orifice when a liquid level in the flash tank chamber rises and to open the orifice when the liquid level in the flash tank chamber lowers.

2. The condenser subassembly as claimed in claim 1, wherein the condenser chamber comprises a heat exchanger for cooling a refrigerant flow through the condenser, wherein the heat exchanger comprises a plurality of tubes passing through the chamber, wherein the plurality of tubes are arranged to be surrounded by the refrigerant flow.

3. The condenser subassembly as claimed in claim 1, wherein the expansion device is fluidly connected to a point near the bottom of the condenser chamber, where during use, condensed refrigerant will collect under the action of gravity.

4. The condenser subassembly as claimed in claim 1, wherein the condenser chamber extends along the full length of the vessel and wherein the flash tank extends along at least part of the length of the vessel.

5. The condenser subassembly as claimed in claim 1, wherein the flash tank chamber comprises a vapour outlet and a liquid outlet, wherein the vapour outlet is arranged to be fluidly connected to an economizer circuit.

6. A refrigeration circuit comprising:

a condenser subassembly as claimed in claim 1;

a compressor; and an evaporator; wherein the condenser subassembly has a vapour outlet which is fluidly connected to an economizer port of the compressor and a liquid outlet which is fluidly connected to the evaporator via a main expansion device, and wherein a discharge port of the compressor is fluidly connected to the condenser chamber.

7. The refrigeration circuit as claimed in claim 6, further comprising an oil separator arranged to remove oil from a refrigerant flow and/or a sound muffler, wherein the oil separator and/or sound muffler is integrated into the condenser subassembly and positioned within the housing, inside of the vessel.

8. A method of manufacturing a condenser subassembly for providing an economizer function in a refrigeration circuit, the method comprising:

providing a housing, wherein the housing defines a vessel;

providing a partition in the vessel;

providing a condenser chamber and a flash tank chamber in the vessel, wherein the condenser chamber and the flash tank chamber are separated from one another by the partition in the vessel; and providing an expansion device inside of the vessel coupled with a liquid duct from the condenser chamber to the flash tank chamber and pass condensed refrigerant from the condenser chamber to the flash tank chamber, wherein the expansion device is an internal float valve comprising:

a float inside the flash tank chamber;

a closing part inside the flash tank chamber defining an orifice through which refrigerant can flow from the condenser chamber to the flash tank chamber; and a pivoting arm connected to the float on one end and to the closing part on another end; and wherein the float, the pivoting arm and the closing part are configured to close the orifice when a liquid level in the flash tank chamber rises and to open the orifice when the liquid level in the flash tank chamber lowers.

9. The method of manufacturing a condenser subassembly as claimed in claim 8, wherein the housing is a pre-existing pressure vessel, and the method comprises retrofitting the partition to the pre-existing pressure vessel in order to form the condenser chamber and a flash tank chamber.

10. The method of manufacturing a condenser subassembly as claimed in claim 8, the method comprising: determining a volume of the vessel, a volume of the condenser chamber and a volume of the flash tank chamber that is required in order to provide a certain economizer function in a refrigeration circuit.

11. The method of manufacturing a condenser subassembly as claimed in claim 8, the method comprising: determining a position and a required strength of the partition in the vessel in order for the partition to withstand a pressure difference between the condenser chamber and flash tank chamber when the condenser subassembly provides a certain economizer function.

12. The condenser subassembly as claimed in claim 1, wherein the vessel is substantially cylindrical and the partition divides the vessel at a chord length in its cross-section along the length of the vessel.

13. The condenser subassembly as claimed in claim 1, wherein the vessel is an outer vessel and the partition forms an inner vessel including a pressure envelope for the flash tank chamber inside of a pressure envelope of the outer vessel.

14. The condenser subassembly as claimed in claim 1, wherein the liquid duct from the condenser chamber to the flash tank chamber is inside of the vessel and the housing.

* * * * *